US006382723B1

(12) United States Patent
Piretti

(10) Patent No.: US 6,382,723 B1
(45) Date of Patent: May 7, 2002

(54) CHAIR WITH SYNCHRONIZED TILTING SEAT AND BACK

(75) Inventor: Giancarlo Piretti, Bologna (IT)

(73) Assignee: Pro-Cord Srl, Bologna (IT)

( * ) Notice: Subject to any disclaimer, the term of this patent is extended or adjusted under 35 U.S.C. 154(b) by 52 days.

(21) Appl. No.: 09/584,753

(22) Filed: Jun. 1, 2000

(30) Foreign Application Priority Data

Jun. 4, 1999 (IT) ..... TO99A0476

(51) Int. Cl.[7] ..... A47C 1/024
(52) U.S. Cl. ..... 297/300.1; 297/302.3
(58) Field of Search ..... 297/300.2, 300.1, 297/300.8, 316, 302.3, 302.1, 325, 326, 327, 328

(56) References Cited

U.S. PATENT DOCUMENTS 5,826,940 A * 10/1998 Hodgdon
5,931,531 A * 8/1999 Assmann
6,109,694 A * 8/2000 Kurtz

FOREIGN PATENT DOCUMENTS

EP 0001 846 A 5/1979
WO WO 96 39897 A 12/1996

* cited by examiner

*Primary Examiner*—Milton Nelson, Jr.
(74) *Attorney, Agent, or Firm*—Sughrue Mion, PLLC

(57) ABSTRACT

Chair with a seat and back tilting in a synchronized way, includes a base structure (14), a seat support structure (18) provided to the base structure (14) about a first transverse axis (22), a back support structure (20) pivoted to the base structure (14) about a second axis (24) parallel to the first, an articulation assembly (48) capable of synchronizing the tilting movements of the seat and the back with each other, an elastic device (32) tending to push the seat (12) and the back (16) towards a forwardly inclined position and tending to oppose rearward tilting of the seat (12) and the back (16), a device to selectively stop the forward tilting travel of the seat and the back in a normal sitting position and in a forwardly inclined position, and a device to immobilize the seat (12) and the back (16) in at least one operating position. A pair of tilting stop members (54, 56) fixed to the seat supporting structure (18) or the back supporting structure (20) are provided and act together with corresponding immobilizing members (68', 68") which slide independently of each other in a direction parallel to the tilting axis (24) or the stop members (54, 56) between a non-operating position and an operating position.

7 Claims, 8 Drawing Sheets

CHAIR WITH SYNCHRONIZED TILTING SEAT AND BACK

FIELD OF THE INVENTION

This invention relates to a chair with a seat and a back which tilt in a synchronized manner.

SUMMARY OF THE INVENTION

More specifically, this invention relates to a chair, in which means are provided to selectively stop the forward tilting travel of the seat and the back in a normal position and in a forwardly inclined position and means to immobilize the seat and the back to the base structure in at least one operating operation.

The purpose of this invention is to provide a chair with a tilting seat and back of the type specified above in which the aforesaid stop and immobilization means have a particularly simple, compact and economical structure.

BRIEF DESCRIPTION OF THE DRAWINGS

In accordance with this invention, this object is accomplished by a chair having the features constituting the subject-matter of the claims.

This invention will now be described in detail with reference to the appended drawings, provided by way of a purely non-restrictive example, in which.

DETAILED DESCRIPTION OF THE INVENTION

Figure 1:
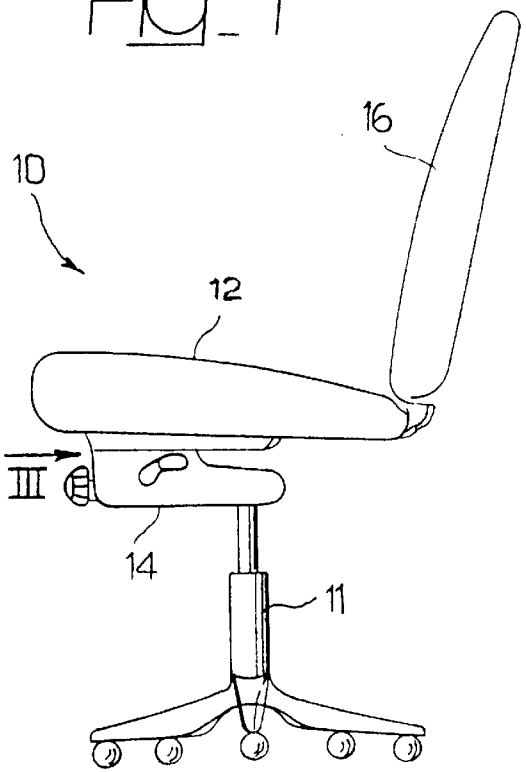
FIG. 1 is a diagrammatical side view of a chair according to the invention.

FIG. 1 illustrates a chair 10 provided with a central support 11 which can be adjusted for height (of a type which is in itself known) which bears at its top a base structure 14. Chair 10 comprises a seat 16 and a back 18 pivoted to base structure 14 about corresponding transverse axes.

Figure 3:
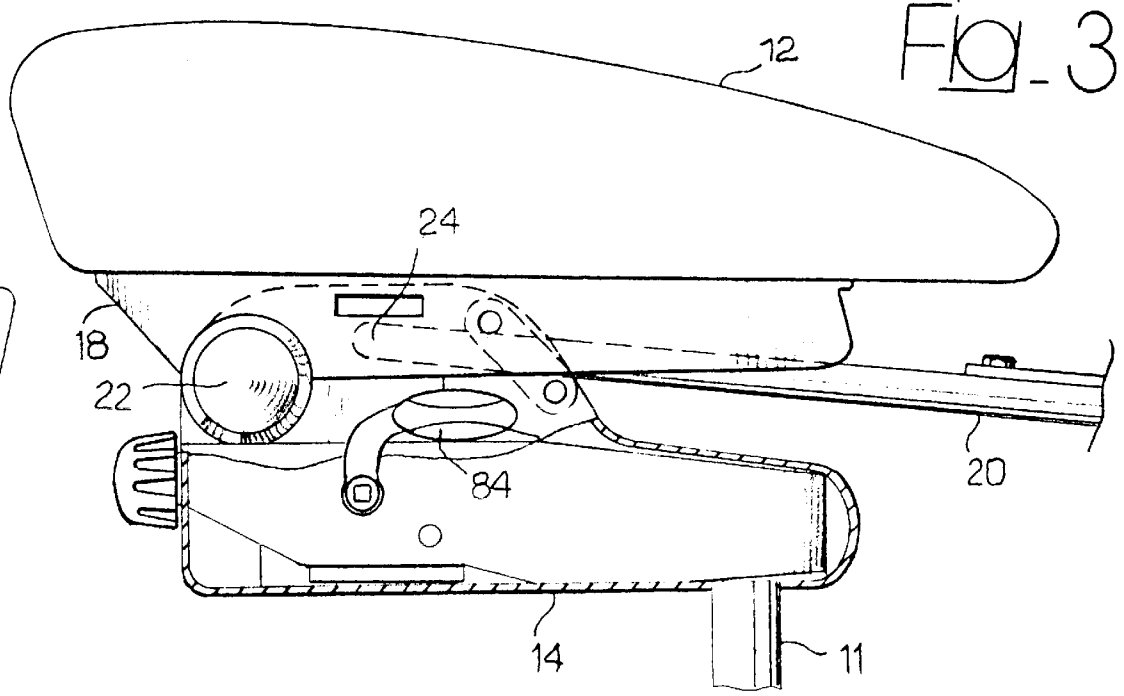
FIG. 3 is a side view on an enlarged scale of the part indicated by arrow III in FIG. 1, FIGS. 4 and 5 are cross sections along the line IV—IV in FIG. 2 in two different operating positions.

With reference to FIG. 3, seat 12 and back 16 are supported by corresponding support structures 18, 20 which are pivoted to base structure 14 about corresponding axes 22, 24 which are parallel to each other and at right angles to the plane of illustration in FIG. 3.

Figure 2:
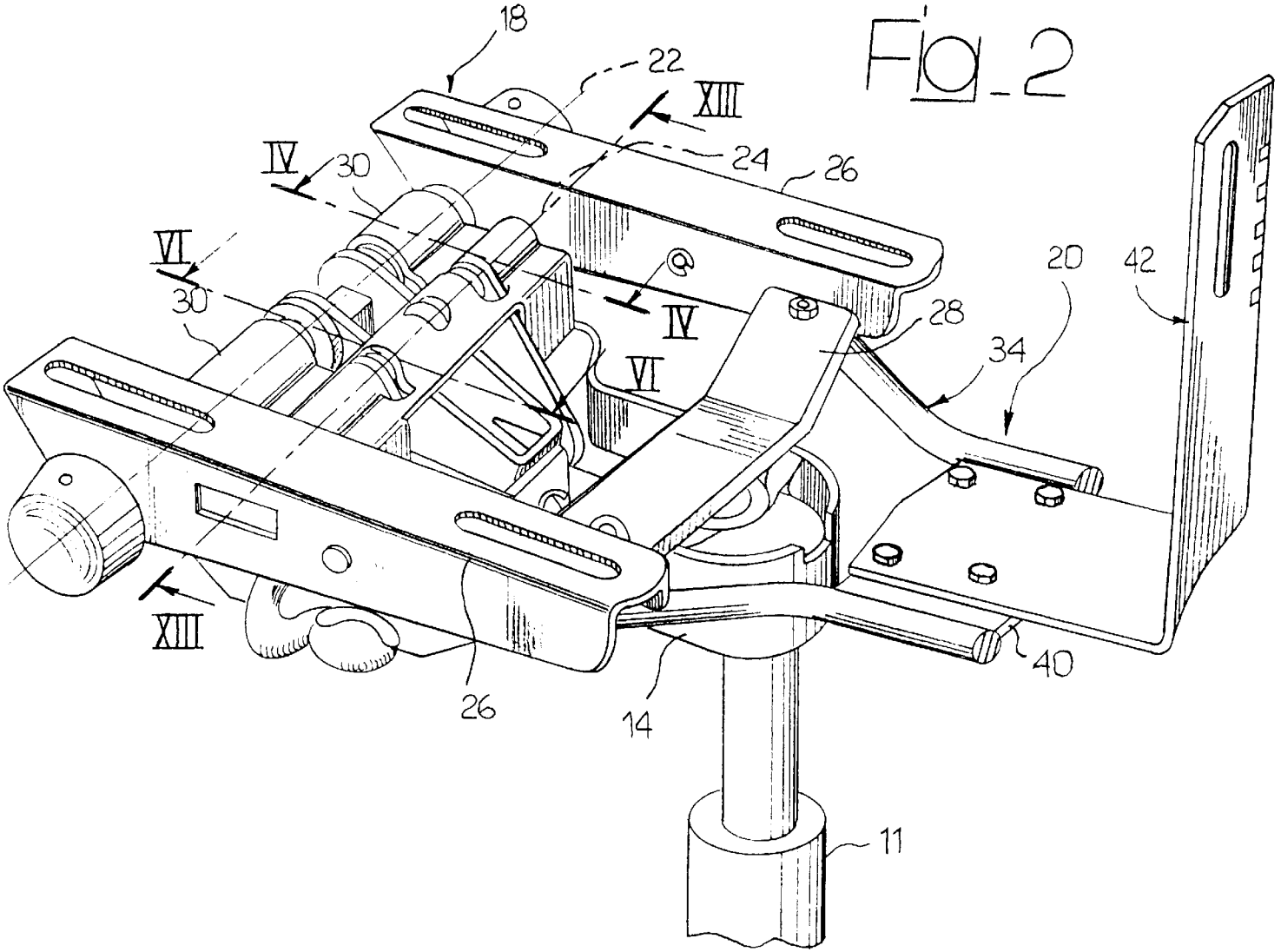
FIG. 2 is a perspective view of the mechanism for tilting the seat and the back of the chair according to the invention.

With reference to FIG. 2, from the point of view of its construction, seat supporting structure 18 comprises a pair of longitudinal side members 26 which are parallel to each other and connected together by means of a rear plate 28.

Two tubular members 30 are fixed to longitudinal members 26 and extend coaxially with tilting axis 22. As described in detail in a simultaneous patent application by the same applicant, a torsion bar indicated by 32 in FIGS. 4 to 7 comprises tilting axis 22 between seat supporting structure 18 and base structure 14. The lateral ends of torsion bar 32 are fixed to seat supporting structure 18 while a central portion of torsion bar 32 acts together with an adjustment device (not illustrated) borne by base structure 14. As is described in detail in the simultaneous patent application mentioned above, torsion bar 32 opposes the rearward tilting movement of seat supporting structure 18 and the adjustment device enables the user to vary the elastic force which opposes the rearward tilting movement of the seat.

Figure 8:
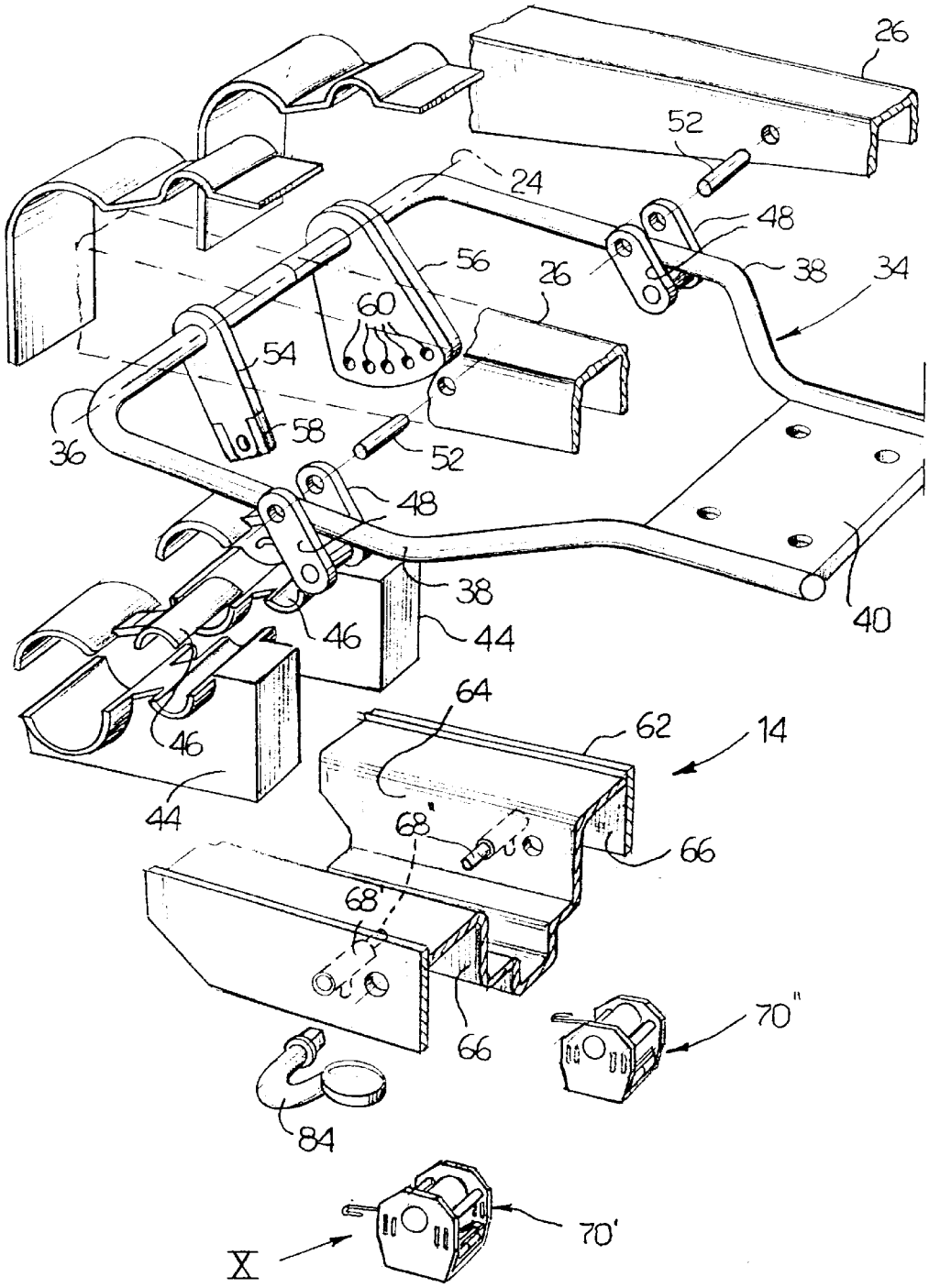
FIG. 8 is an exploded perspective view of part of the mechanism in FIG. 2.

With reference to FIGS. 2 and 8, back supporting structure 20 comprises a frame 34 formed from one or more shaped metal bars defining a transverse section 36 and two longitudinal sections 38. At the rear end of frame 34 there is fixed a plate 40 to which is fixed an L-shaped support 42 to which the back is intended to be fixed. With reference to FIG. 8, base structure 14 comprises a pair of supports 44 on which transverse section 36 of frame 34 is mounted in a pivoting manner. Transverse section 36 therefore defines pivot axis 24 for back supporting structure 20. Transverse section 36 is rotatably mounted on supporting members 44 of base structure 14 by means of bushes 46.

Figure 9:
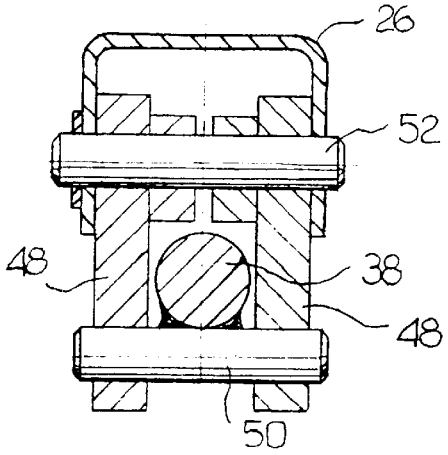
FIG. 9 is a cross section along the line IX—IX in FIG. 7.

Still referring to FIG. 8, longitudinal sections 38 of frame 34 are connected to the seat supporting structure by means of two pairs of connecting members 48. With reference to FIG. 9, each pair of connecting members 48 is fixed to a pin 50 which is welded to the corresponding longitudinal section 38 of frame 34. The upper ends of connecting members 48 are pivoted on a corresponding longitudinal side member 26 by means of a pin 52. Connecting members 48 comprise means of articulation which synchronize the tilting movements of the seat and the back. In fact, seat supporting structure 18 and back supporting structure 20 are not free to tilt independently about corresponding axes 22, 24. Connecting members 48 constitute a link which constrains the seat and the back to perform tilting movements which are correlated with each other.

Still with reference to FIG. 8, a pair of stop members 54, 56 are fixed to transverse section 36 of the back supporting structure. Synchronized tilting movements of the seat and back therefore cause stop members 54, 56 to rotate about transverse axis 24. As an alternative stop, members 54, 56 can be fixed to the seat supporting structure. First stop member 54 is substantially in the shape of a lever and preferably bears a plug 58 of deformable material at its free end. Second stop member 56 comprises a plate having the shape of a sector of a circle equipped with a plurality of holes 60 which are angularly spaced apart and all located at the same distance from pivot axis 24.

Still with reference to FIG. 8, base structure 14 has a portion 62 which defines a longitudinal channel 64 through which the two immobilizing members 54, 56 can move. Channel 64 is bounded laterally by a pair of members 66 of upside-down U-shape in transverse cross section. Two immobilizing pins 68', 68" are supported by U-shaped members 66 in such a way that they can slide in a direction parallel to tilting axis 24 of stop members 54, 56. Immobilizing pins 68', 68" are associated with corresponding control devices 70', 70" inserted within members 66 of upside-down U-shaped cross section.

Figure 10:
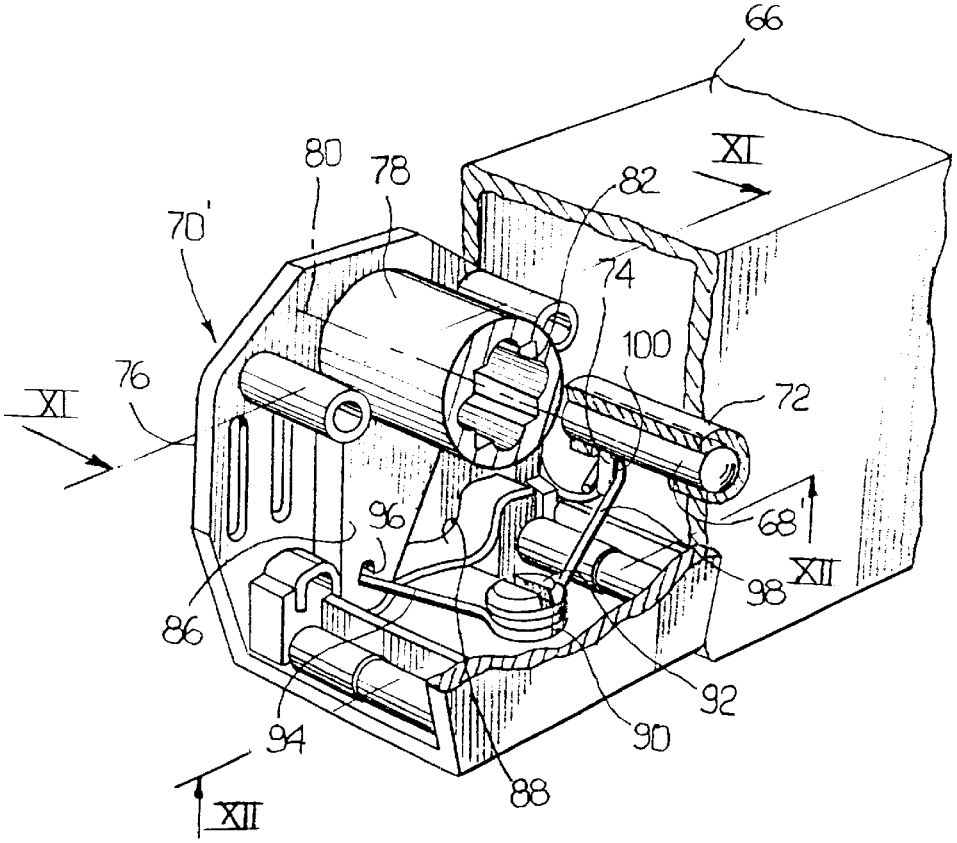
FIG. 10 is a perspective view in partial cross section and on an enlarged scale of the part indicated by arrow X in FIG. 8, FIGS. 11 and 12 are cross sections along the lines XI—XI and XII—XII in FIG. 10, and FIGS. 13, 14 and 15 are cross sections along the line XIII—XIII in FIG. 2 in three different operating positions.
Figure 11:
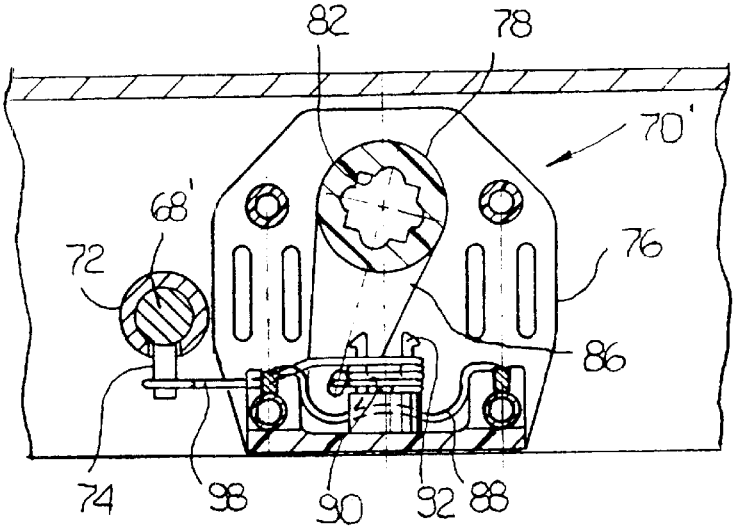
Figure 12:
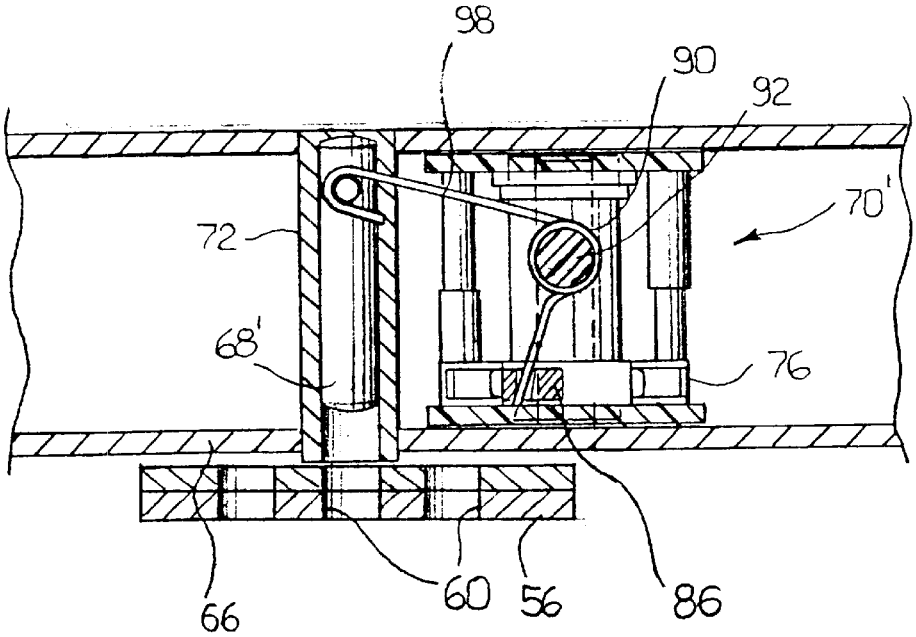

With reference to FIGS. 10, 11 and 12, each immobilizing pin 68', 68" is mounted so that it can slide in the direction of its own longitudinal axis within a cylindrical guide 74 fixed to member 66 of upside-down U-shaped cross section. Each immobilizing pin 68', 68" has a small radial arm 74 which projects beyond cylindrical guide 72 through a slot which extends in the direction in which the pin slides. Each control device 70', 70" comprises an envelope of plastics material 76 which is fixed within a corresponding upside-down U-shaped member in the vicinity of immobilizing pin 68', 68". Device 70 comprises a tilting body 78 which is rotatably mounted within enclosure 76 about an axis 80 parallel to the direction in which immobilizing pin 68 slides. Tilting body 78 has a hole 82 within which the end of an operating lever 84 (FIGS. 3 and 8), which can be operated manually by the user, is inserted and immobilized. Tilting body 78 has an arm 86 whose end acts together with an elastic blade 88 supported by enclosure 76. Blade 88 has a shape such as to define two stable positions of tilting body 78. By operating lever 84, tilting body 78 can be displaced from one of the two stable positions to the other overcoming the slight elastic resistance provided by blade 88. Each control device 70 is equipped with a brooch spring 90 rotatably mounted about a pin 92, which is incorporated with enclosure 76, extending at right angles to the axis of rotation 80 of tilting body 78. Brooch spring 90 has a first arm 94 which engages a hole 96 provided in the end of arm 86 and a second arm 98 having an end 100 which is bent into a U-shape, within which arm 74 of immobilizing pin 68 is engaged. In a first operating position of control device 70, brooch spring 90 presses pin 68 towards a non-operating withdrawn position in which the pin does not project outside overturned U-shaped member 76. When tilting body 78 is moved to its second operating position by rotation of operating lever 84, brooch spring 90 elastically presses immobilizing pin 68 into an immobilizing position in which pin 68 projects into channel 64 (FIG. 8) and interferes with corresponding immobilizing member 54 or 56. The chair is provided with two operating levers located one on the right hand side and one on the left hand side for independent control of one or other of control devices 70', 70" respectively associated with immobilizing members 54 and 56.

Figure 6:
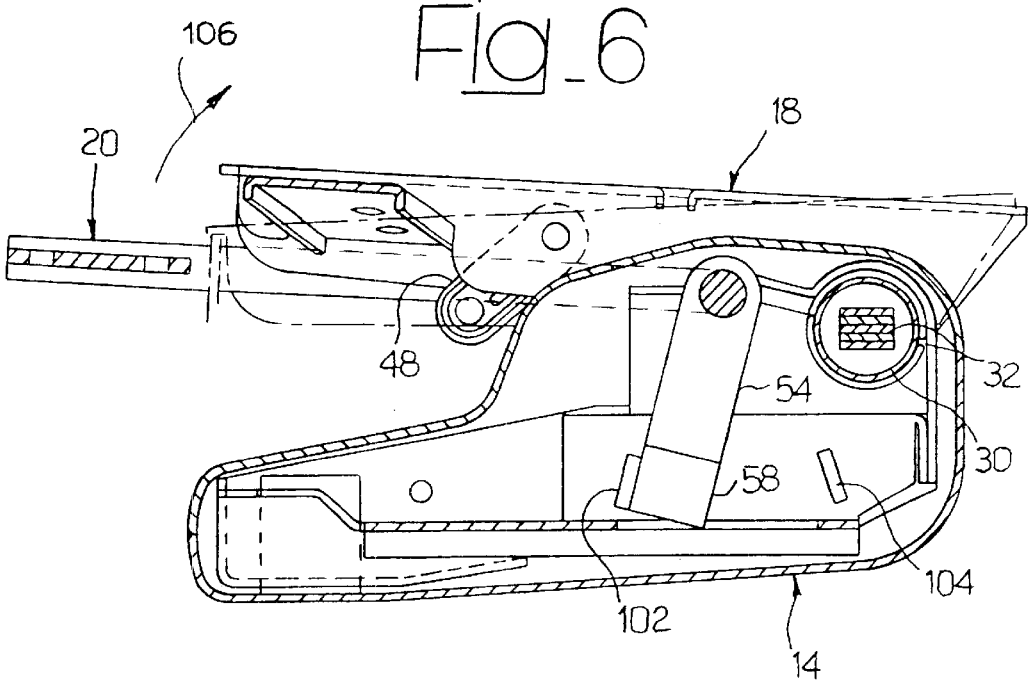
FIGS. 6 and 7 are cross sections along the line VI—VI in FIG. 2 in two different operating positions.
Figure 7:
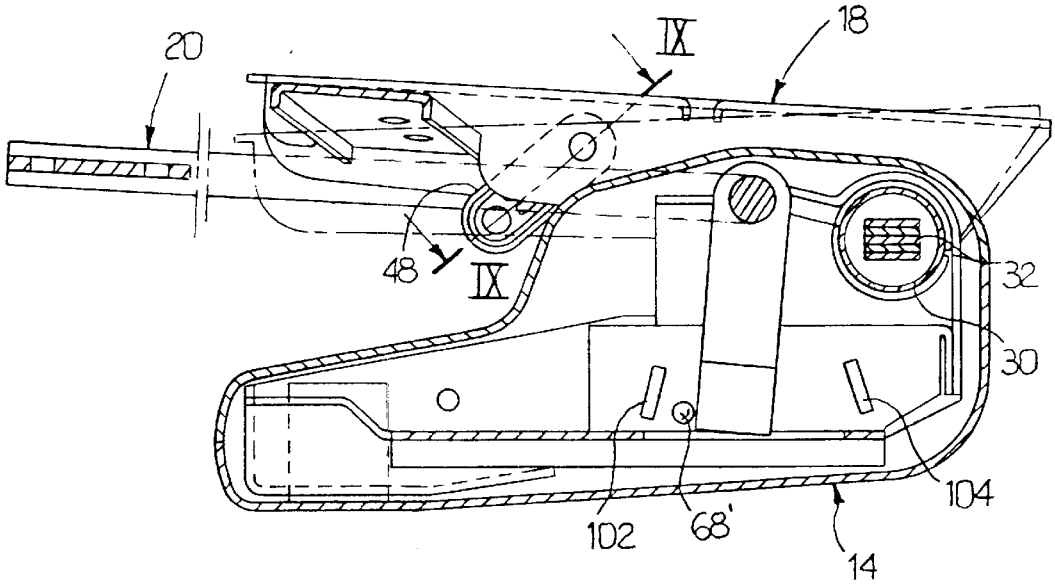

With reference to FIGS. 6 and 7, immobilizing member 54 acts together with two end stop members 102, 104 which are fixed with respect to a structure 14. FIG. 6 illustrates the position adopted by the chair in the resting condition (that is when no one is sitting upon it) when immobilizing pin 68' is in the non-operating position. Torsion spring 32 constantly presses seat supporting structure 18 in the direction indicated by arrow 106. The preloading on torsion bar 32 holds stop member 54 in contact against end stop member 102. The condition in which stop member 54 is in contact with end stop member 102 defines a forwardly inclined position of the seat and back. This position is designed specifically to provide an ergonomic position which facilitates work at a keyboard. When the user places all his weight backwards, stop member 54 rotates about axis 24 until it comes into contact with end stop member 104. This position defines the condition of maximum rearward inclination of the seat and back. FIG. 7 illustrates the condition in which immobilizing pin 68" is in the working position. As will be noted, immobilizing pin 68' defines an end-of-travel position for stop member 54 which is displaced with respect to the forwardly-inclined position defined by contact between stop member 54 and end of travel member 102. In the position in FIG. 7 the chair is in the normal sitting position. In the operating condition in FIG. 6 the seat and the back are free to tilt between the forwardly-inclined position and the position of maximum rearward inclination, while in the condition in FIG. 7 the seat and the back can tilt between the normal sitting position and the position of maximum rearward inclination. The user can pass from one operating position to the other by rotating operating lever 84, located for example on the left hand side of the chair, between its two limit positions.

So that the seat and the back are free to tilt about corresponding axes 22, 24, immobilizing pin 68" (the one associated with stop member 56) must be in the non-operating position. The operating lever, which is for example located on the right- hand side of the chair, enables the user to set an operating condition in which the seat and the back are free to tilt and an operating condition in which the seat and the back are immobilized in a predetermined position. When immobilizing pin 68" is in the operating position, it is elastically pressed against stop member 56.

Figure 4:
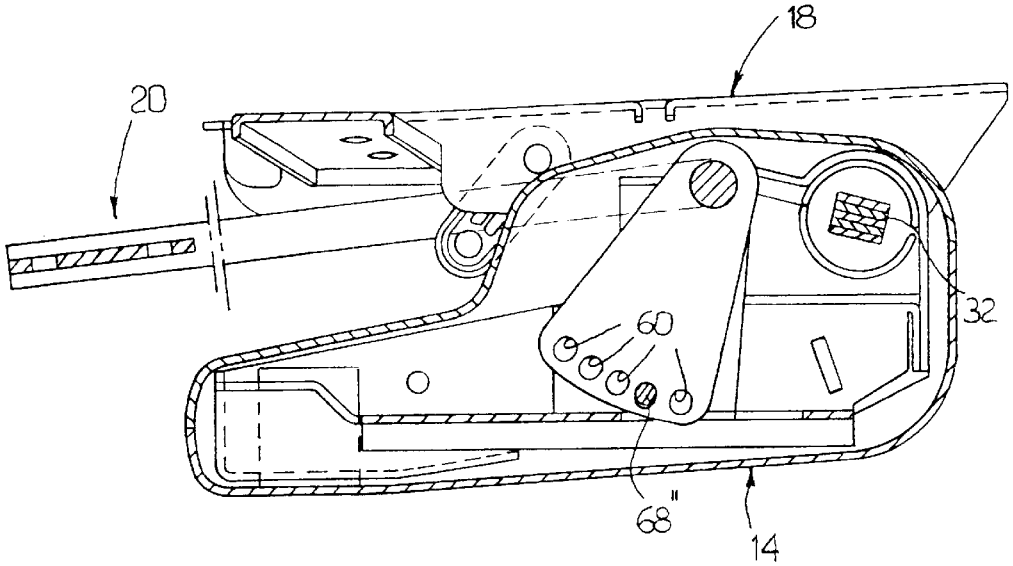
Figure 5:
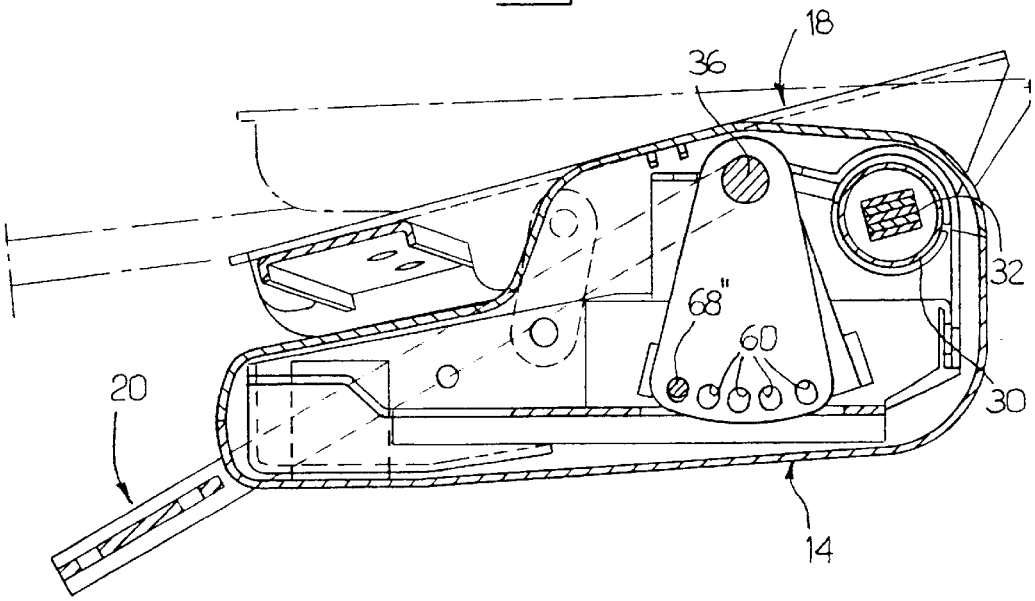

Immobilizing pin 68 is located on the path of holes 60. Therefore if the seat and the back are in a position such that one of holes 60 is precisely in line with immobilizing pin 68" when the latter is placed in its operating position, it engages the hole and holds the seat and the back immobilized in that position. If instead none of holes 60 are aligned with pin 68" at the time when immobilizing pin 68" is placed in its operating position, pin 68" is elastically pressed against stop member 56. As soon as one of holes 60 is aligned with pin 68" through the effect of forward or rearward tilting of the seat and back, pin 68 engages the hole as a result of the thrust from the corresponding spring. FIGS. 4 and 5 illustrate two of the possible immobilizing positions. The number of immobilizing positions is equal to the number of holes 60 provided in stop member 56. In the configuration in FIG. 4 the seat and the back are immobilized in a position close to the position of normal forward inclination, while in the position in FIG. 5 the seat and the back are immobilized in the position of maximum rearward inclination.

Figure 13:
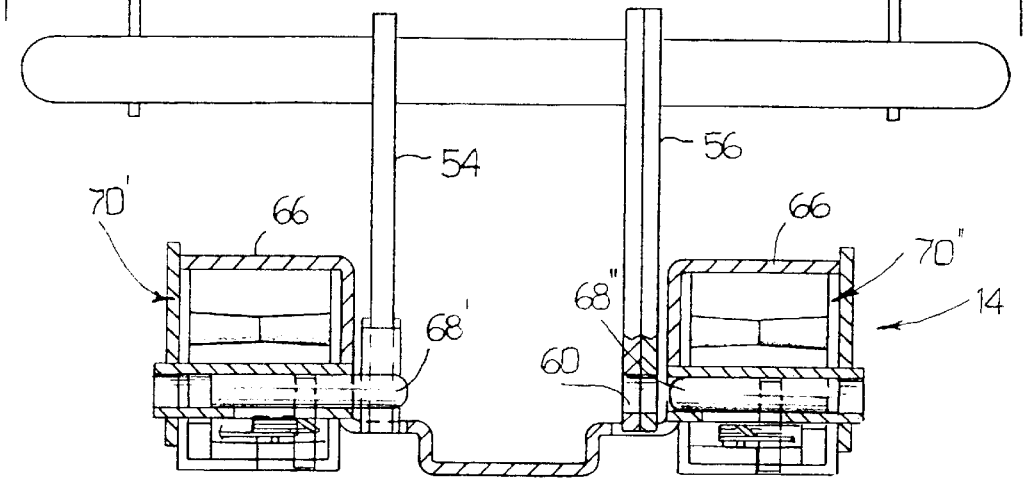
Figure 14:
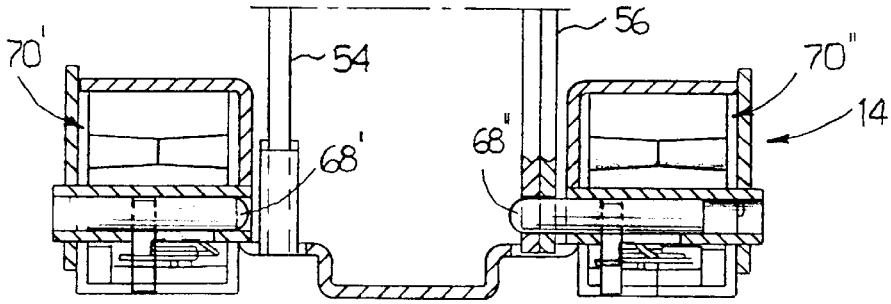
Figure 15:
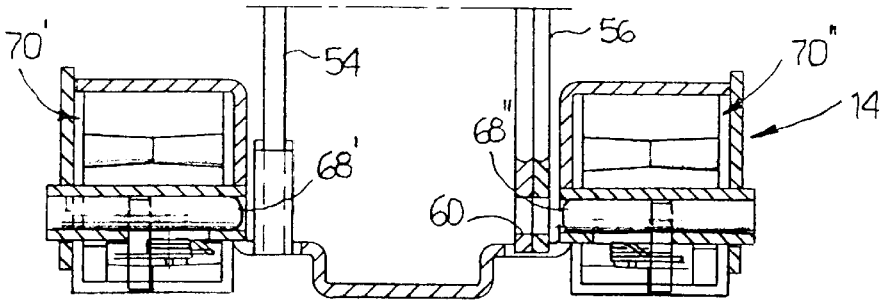

FIGS. 13, 14 and 15 illustrate the various operating positions of the chair according to this invention. In the condition in FIG. 13, immobilizing pin 68' is in the operating position and immobilizing pin 68" is in the non-operating position. In this condition the seat and the back are free to tilt between the normal sitting position and the position of maximum rearward inclination.

In the position in FIG. 14, immobilizing pin 68" is in the operating position while immobilizing pin 68' is in the non-operating position. In this case the seat and the back are immobilized in one of the various possible immobilized positions. Finally, in the condition illustrated in FIG. 15, both pin 68' and pin 68" are in the non-operating position. In this condition the seat and the back are free to tilt between the forwardly-inclined position and the position of maximum rearward inclination.

What is claimed is:

1. Chair with a seat and back which tilt in a synchronized manner, comprising:

a base structure, a seat supporting structure pivoted to the base structure about a first transverse axis, a back supporting structure pivoted to the base structure about a second axis parallel to the first, means of articulation which are capable of synchronizing the tilting movements of the seat and the back, elastic means tending to press the seat and the back towards a forwardly inclined position and tending to oppose rearward tilting of the seat and the back, means for selectively stopping the forwards tilting travel of the seat and the back in a normal sitting position and in a forwardly-inclined position, and means to immobilize the seat and the back in at least one operating position, wherein the chair further comprises a pair of tilting stop members fixed to the back supporting structure and acting together with corresponding immobilizing members borne by the base structure which can slide independently of each other in a direction parallel to the tilting axis of the said stop members between a non-operating position and an operating position.

2. Chair according to claim 1, wherein a first of the said tilting stop members acts together with a pair of end stop members fixed to the base structure respectively defining a forwardly-inclined position of the seat and the back and a position of maximum rearward inclination, a first of said immobilizing members acting together with said first stop member to define an end-of-travel position corresponding to a normal sitting position of the seat and back.

3. Chair according to the claim 1, wherein a second tilting stop member has a plurality of holes located equidistant from the tilting axis of the second stop member, the said holes being located in such a way as to move along a circular path and a second of said immobilizing members being arranged so as to engage one of said holes.

4. Chair according to claim 1, wherein the aforesaid elastic means comprise a torsion bar extending parallel to the pivot axis of the seat supporting structure.

5. Chair according to claim 1, wherein the back supporting structure comprises a frame including a transverse section and two longitudinal sections, the transverse section being pivoted to the base structure about the said second axis and the aforesaid tilting stop members being fixed to the said transverse section.

6. Chair according to claim 1, comprising a pair of control devices which can be operated manually and which are capable of displacing the corresponding immobilizing members between an operating position in which the immobilizing members do not interact with the tilting stop members respectively, and an operating position in which the immobilizing members are pressed elastically to a position in which they engage the tilting stop members, respectively.

7. Chair according to claim 6, wherein each of the control devices comprises a tilting body which can move between two operating positions and elastic means capable of displacing the associated immobilizing member between the operating position and the non-operating position in accordance with the angular position of the said tilting body.

* * * * *